United States Patent [19]

Tubbs

[11] Patent Number: 4,978,280

[45] Date of Patent: Dec. 18, 1990

[54] VARIABLE GUIDE VANE ARRANGEMENT FOR A COMPRESSOR

[75] Inventor: Henry Tubbs, Kingscote, England

[73] Assignee: Rolls-Royce plc, London, England

[21] Appl. No.: 355,022

[22] Filed: May 22, 1989

Related U.S. Application Data

[63] Continuation-in-part of Ser. No. 233,123, Aug. 17, 1988, Pat. No. 4,867,635.

[30] Foreign Application Priority Data

Sep. 26, 1987 [GB] United Kingdom ..... 8722714

[51] Int. Cl.[5] ..... F01D 17/16

[52] U.S. Cl. ..... 415/159; 415/162

[58] Field of Search ..... 415/150, 151, 148, 155, 415/156, 159, 160, 162; 74/105

[56] References Cited

U.S. PATENT DOCUMENTS

| | | | |
|---|---|---|---|
| 2,858,062 | 10/1958 | Allen | 415/150 |
| 3,397,836 | 8/1968 | Badger et al. | 415/150 |
| 4,049,360 | 9/1977 | Snell | 415/149.4 |
| 4,130,375 | 12/1978 | Korta | 415/162 |
| 4,373,859 | 2/1983 | Thebert | 415/159 |
| 4,400,135 | 8/1983 | Thebert | 415/162 |
| 4,867,635 | 9/1989 | Tubbs | 415/159 |

FOREIGN PATENT DOCUMENTS 907373 10/1962 United Kingdom .

*Primary Examiner*—John T. Kwon

*Attorney, Agent, or Firm*—Cushman, Darby & Cushman

[57] ABSTRACT

A variable guide vane arrangement includes a control ring located in a fixed axial position and an operating lever having a first end and a second end which is secured to the control ring with the first end positioned between two flanges and secured thereto by a pin; the second end is connected to a portion which fits into a bore and is slidable with respect thereto to vary the length of the operating lever.

16 Claims, 6 Drawing Sheets

VARIABLE GUIDE VANE ARRANGEMENT FOR A COMPRESSOR

This is a Continuation-in-Part of Application Ser. No. 07/233,123 filed Aug. 17, 1988 now U.S. Pat. No. 4867,635.

The present invention relates to a variable guide vane arrangement for a compressor, particularly an axial flow compressor for an aircraft gas turbine engine, whether a turbofan a turbojet or a turbopropeller engine.

Aircraft installed turbofan and turbojet engines are frequently provided with a shaped intake duct which matches the aircraft configuration. These shaped intakes may be arranged non-symmetrically about the compressor axis.

Turbopropeller engines frequently comprise a gearbox and a drive shaft which are arranged off centre from the compressor axis, and a curved intake duct which is partially blocked by the drive shaft.

These non-symmetrical intake ducts generate flow distortions at the entry plane of the compressor.

Similar flow distortions are also produced in symmetrical intake ducts on turbofan, turbojet or turbopropeller engines when the aircraft flies in an inclined attitude during for example take off, or other manoeuvres.

Both these effects may combine when an aircraft having a non-symmetrical intake duct flies in an inclined attitude.

One of the most common forms of inlet flow distortion is a deficiency in air flow velocity in one zone of the compressor entry plane. Also common is a variation in airflow direction or swirl around the entry plane.

The effects of these variations, in airflow velocity or airflow directions, are in general that one circumferential zone of the compressor is required to perform a more arduous duty than the remainder in order to sustain the same outlet static pressure within the gas turbine engine. Ultimately that zone will stall prematurely, possibly causing surging of the gas turbine engine.

One method of reducing the distortion of the inlet airflow at the entry plane of the compressor has been to design long intakes and provide flow controlling devices such as splitters. However such intakes are relatively heavy and bulky, and introduce penalties due to frictional pressure losses, and it is impractical to achieve uniform conditions at the compressor entry plane under all operating conditions.

Normally the compressor is designed to have a sufficient surge margin above the design operating requirement so that the zone affected by the inlet flow distortion can still operate satisfactorily. The compressor may be provided with variable stator vanes, casing treatments, and blades or vanes which have special shapes at their tips and roots to achieve this. These treatments all give axisymmetric improvements to the air flow.

The present invention seeks to provide further improvements in the tolerance of an axial flow compressor to inlet flow distortions using non-axisymmetric operation of the variable stator vanes.

Accordingly the present invention provides a variable stator vane arrangement for an axial flow compressor comprising a plurality of circumferentially arranged radially extending stator vanes mounted for rotation about their longitudinal axes in a stator structure, a control ring surrounding the stator structure, a plurality of circumferentially arranged operating levers, each operating lever extending from the control ring to a respective stator vane, the control ring being movable between a first position in which the control ring is coaxial with the compressor and a second position in which the axis of the control ring is displaced transversely with respect to the axis of the compressor, the control ring being movable from the first position to the second position such that the stator vanes in a first circumferentially extending zone of the compressor are rotated in a first direction whereby the first zone operates at a relatively higher pressure ratio and the stator vanes in a second diametrically opposite circumferentially extending zone of the compressor are rotated in the opposite direction whereby the second zone operates at a relatively lower pressure ratio.

Each operating lever may be secured to the radially outer end of a respective stator vane by hinge means so that each operating lever may pivot in a radial direction to a low transverse movement of the control ring.

Each operating lever may have a spherical portion which engages a correspondingly shaped aperture in the control ring.

Each operating lever may comprise two parts, one part being slidably mounted in the other to allow for variation in the effective length of the operating levers.

The control ring may be rotatably mounted coaxially in a second control ring, the second control ring being movable between the first position in which the control ring is coaxial with the compressor and the second position in which the axis of the control ring is displaced transversely with respect to the axis of the compressor.

The control ring may be rotatably mounted in the second control ring by bearing means.

The bearing means may comprise a roller bearing, a ball bearing or a sliding bearing.

The second control ring may have first transversely extending track means, and the stator structure has second transversely extending track means, the first and second transversely extending track means being arranged parallel to allow and to guide the relative movement between the second control ring and the stator structure.

Bearing means may allow relative movement between the second control ring and the stator structure.

The bearing means may comprise a roller bearing, a ball bearing or a sliding bearing.

The second control ring may be connected to the stator structure by two parallel links, the two parallel links being pivotally connected to the second control ring and the stator structure.

The parallel links may be of equal length.

The parallel links may be arranged substantially perpendicular to the required direction of transverse movement to allow lateral movement.

An actuating ram may be interconnected to the stator casing and second control ring to move the second control ring transversely.

The control ring may be rotated about the axis of the second control ring whereby the stator vanes rotate in the same direction.

The control ring may be rotatably mounted on the stator structure about the axis of the compressor, the control ring being rotated whereby the stator vanes rotate in the same direction.

The axial flow compressor may be the compressor of a gas turbine engine.

The present invention will be more fully described by way of example with reference to the accompanying drawings, in which.

Figure 1:
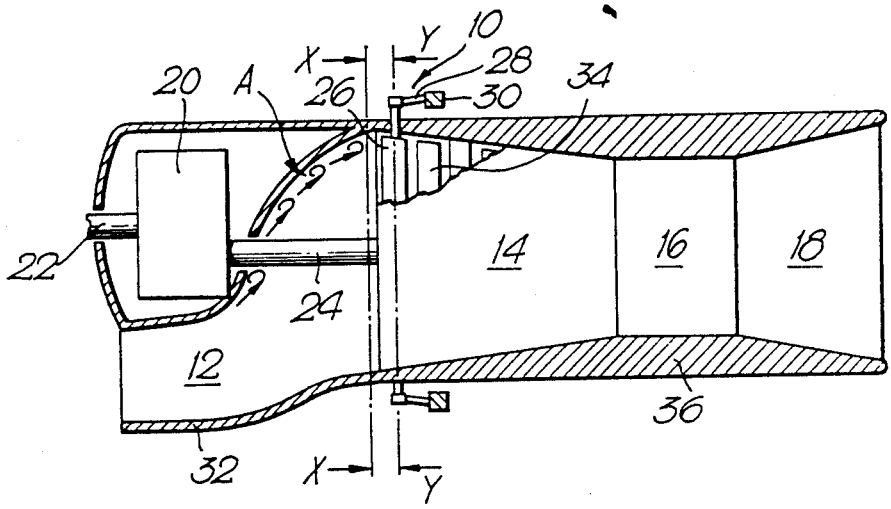
FIG. 1 is a partially cut away view of a turbopropeller gas turbine engine having a variable stator vane arrangement according to the present invention.

A turbopropeller gas turbine engine 10 shown in FIG. 1 comprises in axial flow series a chin type intake duct 12, which is non-symmetrically arranged about the engine axis, an axial flow compressor 14, a combustor means 16, and a turbine means 18. A gearbox 20 is positioned upstream of the compressor 14, and the gearbox 20 is driven via a shaft 24, and in turn drives a propeller (not shown) via a shaft 22. In operation air flows through the intake duct 12 to the compressor 14 where the air is compressed before flowing into the combustor means 16. Fuel is injected into the combustor and is burnt in the compressed air to produce hot gases which flow through and drive the turbine means 18. The turbine means 18 drives the compressor 14 and the gearbox via the shaft 24.

Figure 3:
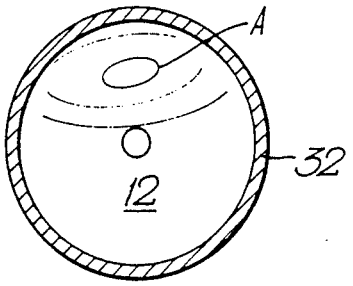
FIG. 3 is a sectional view in the direction of arrows X—X in FIG. 1 depicting the inlet airflow distortion.

The intake duct 12 is defined by an intake casing 32, and because of the non-symmetrical shape of the intake duct 12 flow distortions A are produced in the upper half of the intake duct 12 as shown in FIG. 3. Consequently the upper half of the compressor 14 is required to perform a more arduous duty in order to sustain the same outlet static pressure within the gas turbine engine.

The compressor 14 is provided with a variable stator vane arrangement which improves the tolerance of the compressor to inlet flow distortions. The variable stator vane arrangement, shown more clearly in FIG. 4, comprises a plurality of circumferentially arranged variable stator vanes 26 which are rotatably mounted in the stator casing 36. The radially outer end of each variable stator vane 26 has a spindle 50 which is rotatably mounted in a bearing 52 formed on the stator casing 36. The radially inner end of each variable stator vane has a spindle 51 which is rotatably mounted in a bearing 53 on an inner stator structure 37. A plurality of operating levers 28 are arranged circumferentially, and a first end of each operating lever 28 is secured to a respective spindle 50 and a second end of each operating lever 28 is secured to a control ring 30.

The radially outer end of each spindle 50 is provided with two radially outwardly extending spaced flanges 54, and the first end of the respective operating lever 28 is positioned between and is secured to the flanges 54 by a hinge pin 56. Each operating lever 28 may pivot about a hinge pin 56 in a radial direction so as to allow transverse movement of the control ring 30.

The second end of each operating lever 28 has a spherical portion 58 which engages one of a plurality of correspondingly shaped apertures 60 in the control ring 30.

It may be possible to use pin type connections or other devices well known in the art to secure the second end of the operating levers 28 to the control ring 30.

The control ring 30 is slidably mounted on the stator casing 36 so that the control ring may move laterally with respect to the axis of the compressor 14. The control ring 30 and stator casing 36 may be provided with any suitable means of achieving lateral movement of the control ring. For example the control ring may be provided with balls or rollers which are arranged to roll on a pair of parallel laterally extending tracks provided on the stator casing. An actuator mechanism, which may be a hydraulic ram or other suitable means is provided to move the control ring.

Figure 7:
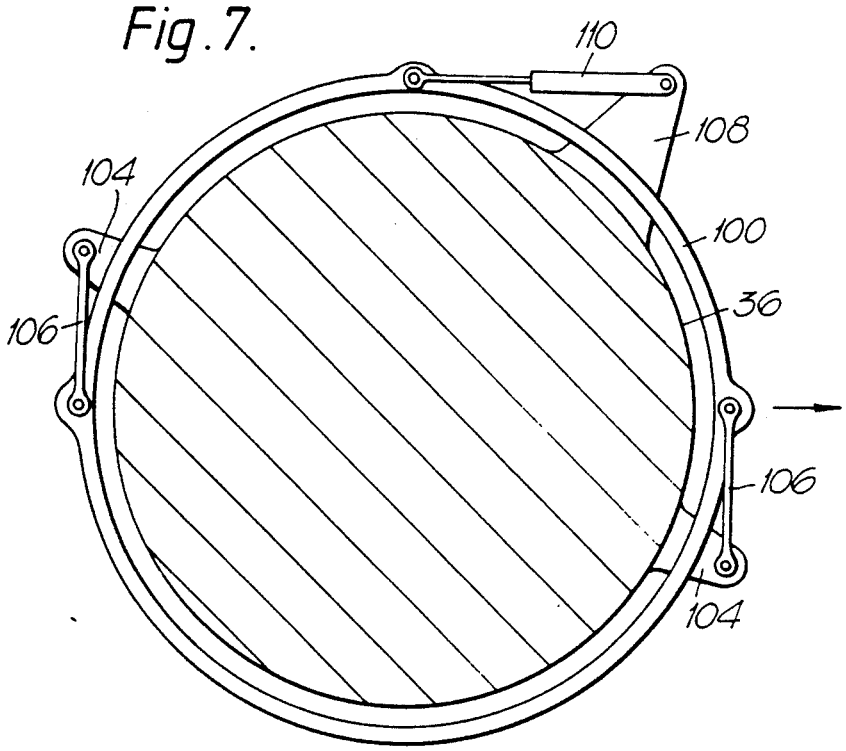
FIG. 7 is an enlarged sectional view in the direction of arrows Y—Y in FIG. 1 showing a control ring and an actuating mechanism for the stator vane arrangement according to the present invention.
Figure 8:
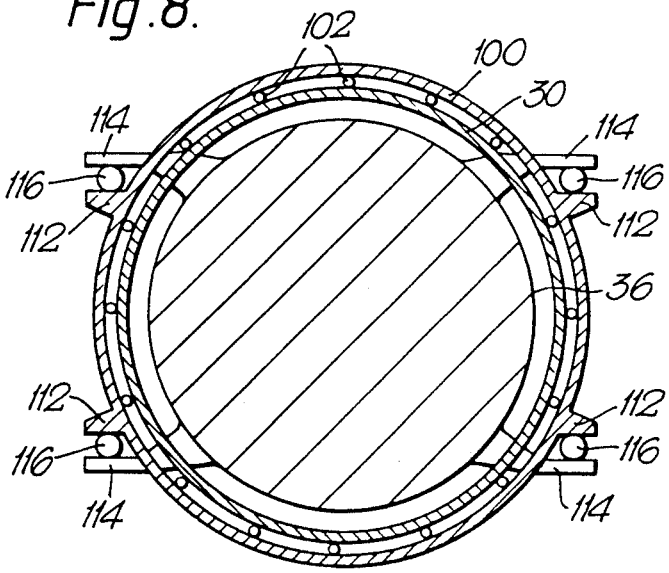
FIG. 8 is an enlarged sectional view in the direction of arrows Y—Y in FIG. 1 showing an alternative embodiment of the control ring for the stator vane arrangement according to the present invention.
Figure 9:
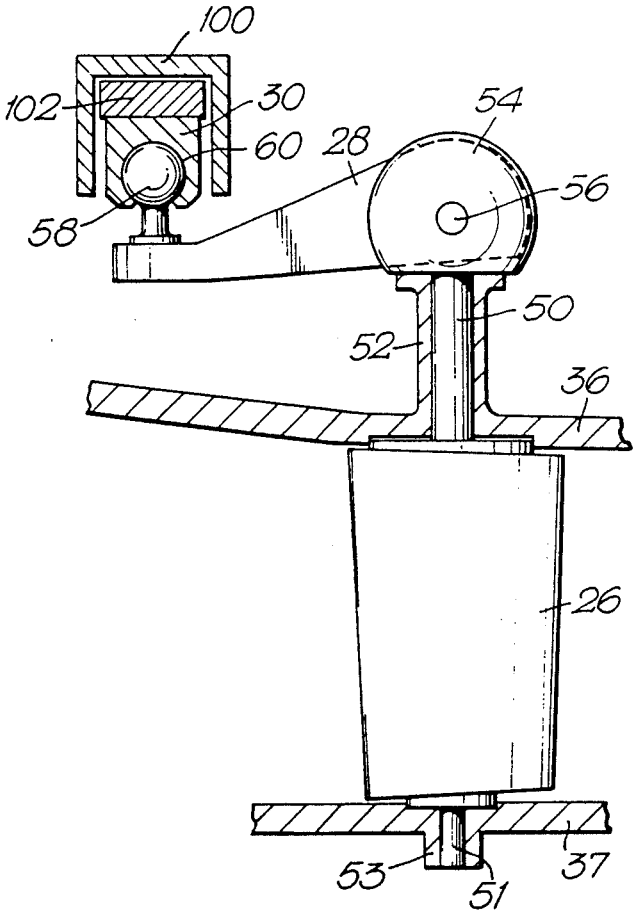
FIG. 9 is a view of a variable stator vane and control ring in FIG. 1 to an enlarged scale.

FIGS. 7, 8 and 9 show two arrangements for mounting the control ring 30 on the stator casing 36 to allow the control ring 30 to move transversely with respect to the axis of the compressor 14, and actuating mechanisms.

In FIG. 7, the control ring 30 is rotatably mounted coaxially in a second control ring 100 by a plurality of roller bearings. The control ring 30 may equally well be rotatably mounted in the second control ring 100 by a ball bearing or by a sliding bearing.

The stator casing 36 has two radially extending members 104, which are arranged diammetrically opposite each other on the stator casing 36. The members 104 are connected with the second control ring 100, at diammetrically opposite positions on the second control ring 100 by parallel link members 106 which are pivotally connected to both the second control ring 100 and the members 104. The link members 106 are of equal length. The members 104 and the link members 106 are arranged such that the link members 106 initially, in a first position, extend substantially perpendicular to the required direction of transverse movement of the control ring 30.

A third radially extending member 108 is secured to the stator casing 36 and is connected with the second control ring 100 by an actuating means 110, which for example is a hydraulic ram.

Figure 5:
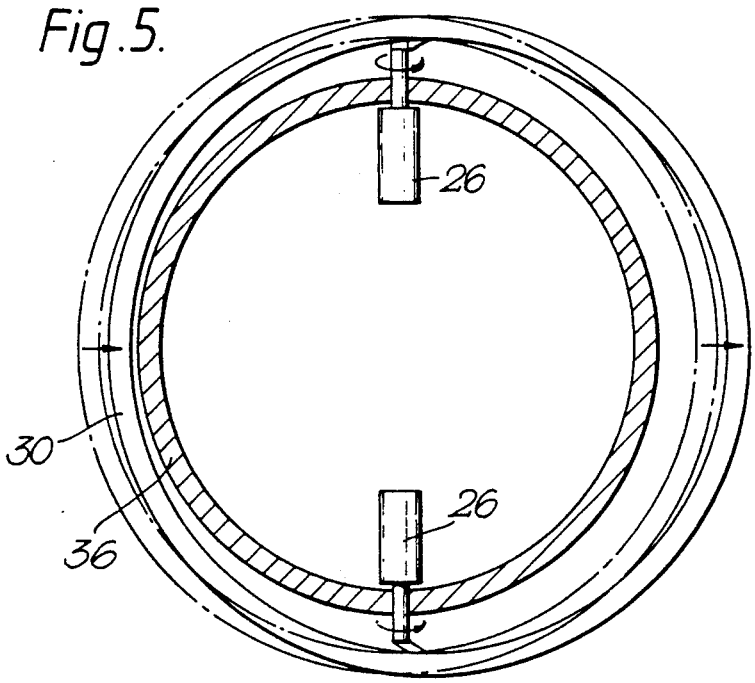
FIG. 5 is an enlarged sectional view in the direction of arrows Y—Y in FIG. 1 showing operation of the stator vane arrangement according to the present invention.

In operation the control ring 30 is moved by the actuator mechanism from a first position, indicated by the broken lines in FIG. 5, in which the control ring is coaxial with the compressor 14 to a second position in which the control ring 30 has been displaced laterally of the compressor axis, in this example the control ring is displaced laterally in a horizontal sideways direction. The control ring can be moved in any direction at 90° to the axis of the compressor.

Operation of the hydraulic ram 110 causes the second control ring 100, and hence the control ring 30, to move from the first position in which the second control ring 100 is coaxial with the compressor 14 to the second position in which the second control ring 100 has been displaced transversely of the compressor axis. The parallel link members 106 allow the second control ring 100 to move in the required direction of transverse movement but prevent transverse movement perpendicular to the required direction of transverse movement.

In FIG. 8, the control ring 30 is also rotatably mounted coaxially in a second control ring 100 by a plurality of roller bearings 102. The second control ring 100 has a plurality of first members 112 which extend therefrom, and which are arranged parallel to each other to form a first set of parallel transversely extending tracks. The stator casing 36 has a plurality of second members 114 which extend therefrom, and which are arranged parallel to each other to form a second set of parallel transversal extending tracks.

The first and second members 112 and 114 are arranged substantially parallel to each other, and are arranged to allow relative movement between the second control ring 100 and the stator casing 36. A plurality of roller bearings 116 are positioned between and run on the first and second members 112 and 114 to allow the relative movement between the second control ring 100 and the stator casing 36. A plurality of ball bearings or a sliding bearing arrangement may equally well be used to allow the free movement between the second control ring and the stator casing.

An actuating means is secured to the stator casing 36 and connected to the second control ring 100.

Operation of the actuator causes the second control ring 100, and hence the first control ring 30, to move from the first position to the second position. The first and second members 112 and 114 guide the movement of the second control ring 100 and first control ring in the required direction of transverse movement.

In the first position of the control ring 30, the variable guide vanes 26 are all arranged at the same angle to the incoming air flow to impart the same amount of whirl to the air throughout the full circumference of the compressor.

When the control ring 30 is moved to the second position, differential rotation of the variable stator vanes 26 occurs. As shown as an example in FIG. 5, the control ring 30 is displaced horizontally and the variable stator vanes 26 in the upper half or circumferentially extending zone of the compressor are rotated to increase the whirl imparted to the air flowing into the upper half or circumferentially extending zone of the compressor, whereas the variable stator vanes 26 in the lower half or circumferentially extending zone of the compressor are rotated to decrease the whirl imparted to the air flowing into the lower half or circumferentially extending zone of the compressor. A single stator vane only has been shown in the upper and lower zones in FIG. 5 for clarity. The variable stator vanes on the horizontal plane of the compressor are not rotated as the lateral movement of the control ring only moves the operating links in a radial direction. The amount of whirl imparted by each variable stator vane in the upper half of the compressor depends on its circumferential position, i.e. there is a progressive increase of whirl imparted from those in the horizontal plane to those in the vertical plane. Similarly, in the lower half of the compressor there is a progressive decrease of whirl.

The variable stator vane arrangement according to the invention allows one half or circumferential extending zone of the compressor to achieve a higher pressure ratio than designed, whilst the diametrically opposite half or circumferentially extending zone of the compressor achieves a lower pressure ratio than designed. The half or zone of the compressor with the higher pressure ratio than designed is arranged to coincide with the zone of the compressor which has a low intake pressure caused by inlet flow distortion, i.e. the vanes are opened in the zone with the low intake pressure, and the vanes are closed in the zone with the high intake pressure.

By opening the stator vanes in the zone of low intake pressure, the work is increased in that zone, and the local flow is induced more strongly. This then concentrates the inlet flow of low intake pressure into a smaller part of the circumference and induces in it a high axial velocity to avoid stalling.

The variable stator vane arrangement may also operate conventionally, in that when the control ring is in the first position the control ring may be rotated about the axis of the compressor to produce adjustments of the angle of the variable stator vanes in the same sense, i.e. they all increase or decrease whirl in unison.

The control ring 30 may be rotated coaxially within the second control ring 100 about the axis of the compressor while in the first position to produce an adjustment of the stator vanes 26 in the same sense using a further actuating means i.e. another hydraulic ram.

The control ring 30 may also be rotated coaxially within the second control ring 100 while in the second position to produce adjustments of the stator vanes in the same sense. However in order to achieve this movement the use of flexible operating levers may be required to allow adjustment without seizing.

Figure 2:
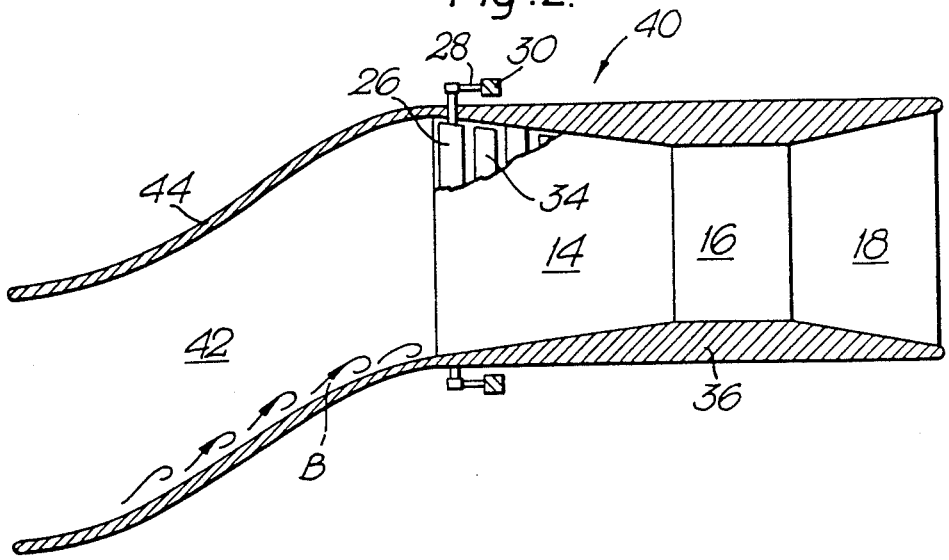
FIG. 2 is a partially cut away view of a turbojet gas turbine engine having a variable stator vane arrangement according to the present invention.

A turbojet gas turbine engine 40 shown in FIG. 2 comprises in axial flow series an axial flow compressor 14, a combustor means 16 and a turbine means 18 similar to those in FIG. 1. The turbojet has a non-symmetrical intake duct 42 defined by an intake casing 44, and because of the non-symmetrical shape of the intake duct flow distortions B may be produced in the lower half of the intake duct 42, as shown. This turbojet gas turbine engine could be one engine of a pair arranged side by side in the fuselage of an aircraft. The other engine would have distortions in the upper half of its respective intake. These distortions, in the intakes of the side by side engines, would be in the halves of the intake ducts remote from the adjacent engine.

Figure 4:
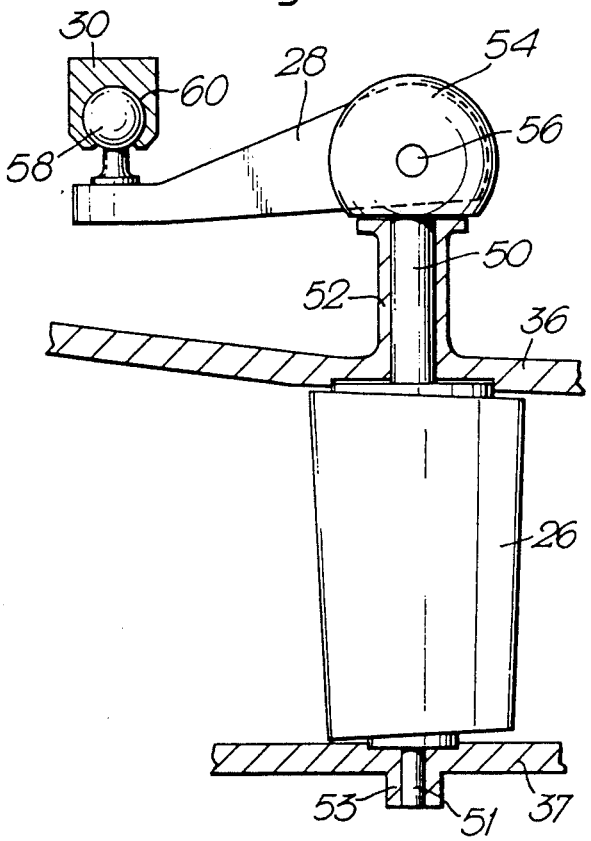
FIG. 4 is a view of the variable stator vane and control ring in FIG. 1 to an enlarged scale.

The compressor is provided with variable stator arrangement 26,28 and 30 which is identical in operation to that shown in FIGS. 1,4 and 5 and is arranged so that the control ring moves in a transverse direction so that the half or zone of the compressor with the higher pressure ratio than designed is arranged to coincide with the half of the compressor which has a low intake pressure caused by the inlet flow distortion.

Figure 6:
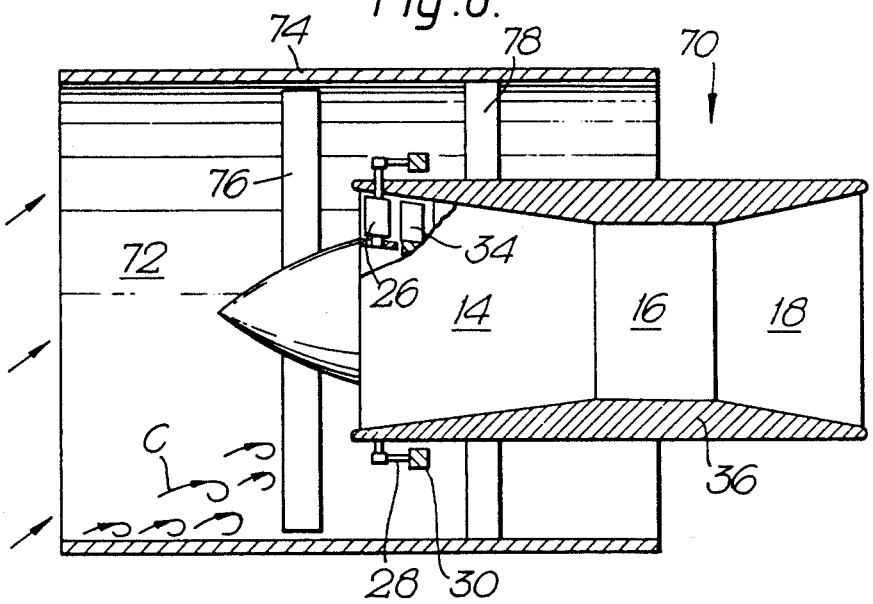
FIG. 6 is a partially cut away view of a turbofan gas turbine engine having a variable stator vane arrangement according to the present invention.

A turbofan gas turbine engine 70 shown in FIG. 6 comprises in axial flow series an axial flow compressor 14, a combustor means 16 and a turbine means 18 similar to those in FIG. 1. The turbofan has an intake duct 72 defined by a fan casing 74, and a fan 76 positioned upstream of the compressor 14 and driven by the turbine means. The fan casing 74 is secured to a stator casing 36. The turbofan intake duct 72 may be symmetrically shaped, but intake flow distortions C in the lower half of the intake duct 72 are produced when the engine is in an inclined position during take off.

The compressor 14 is provided with a variable stator arrangement 26,28 and 30 which is identical in operation that that shown in FIGS. 1,4 and 5, but is arranged so that the control ring moves in a lateral direction so that the half or zone of the compressor with the higher pressure ratio than designed is arranged to coincide with the lower half of the compressor which has a low intake pressure caused by the inlet flow distortion during take off. The control ring may be moved back to the first position during cruise operation.

The operating levers 28 may need to incorporate a degree of sliding or telescoping movement to allow for the variation in the effective length of the levers when the control ring is displaced transversely, and may comprise two parts, one slidably mounted in the other.

Conventional compressor variable stator vane arrangements allow the control ring to move freely in the axial direction, while located on the operating levers. The present invention requires that the control ring be located in a fixed axial position, because of the apparatus needed to move the control ring transversely.

Figure 10:
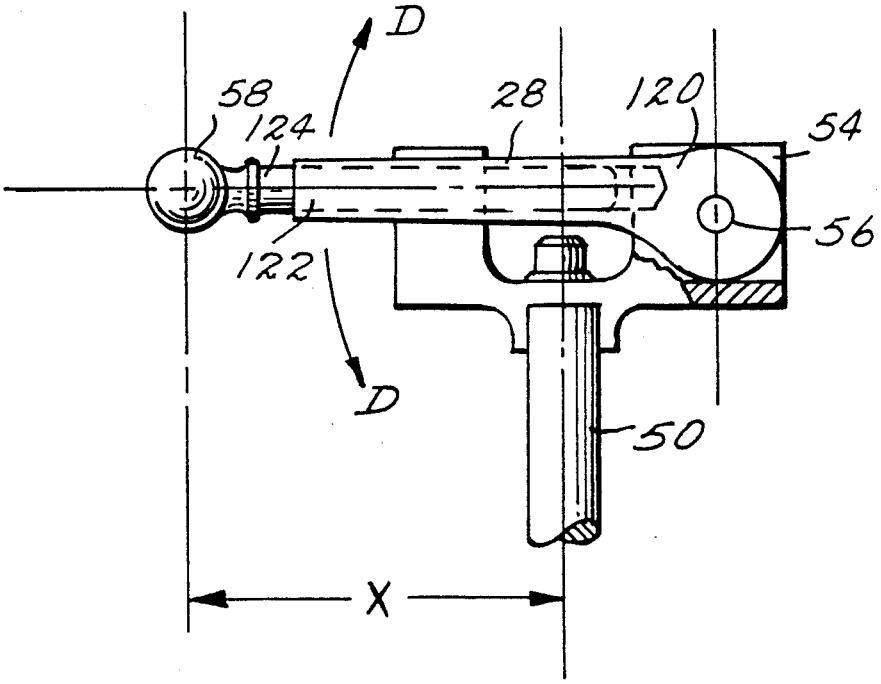
FIG. 10 is a partially cut away view of an alternative operating lever arrangement for the variable stator vane.
Figure 11:
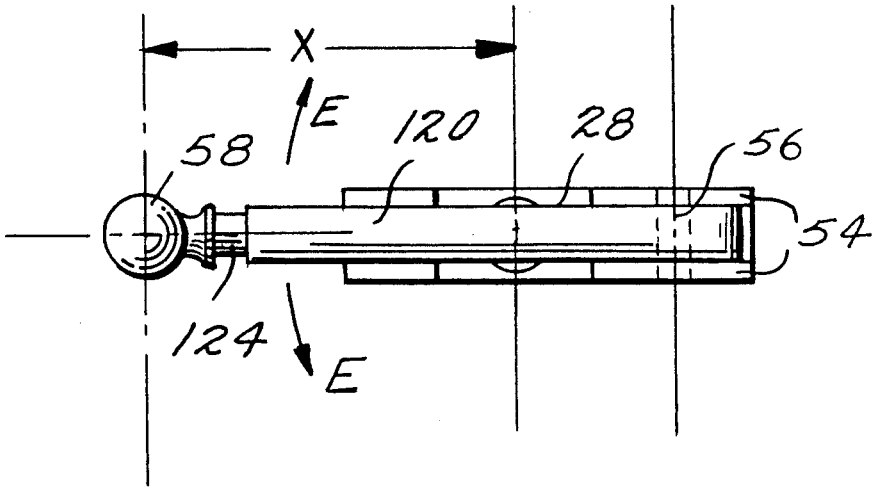
FIG. 11 is a plan view of the operating lever arrangement shown in FIG. 10.

An operating lever 28 is shown in FIGS. 10 and 11 which comprises a first end which is secured to a respective spindle 50, and a second end which is secured to the control ring. The first end of the operating lever 28 is positioned between and is secured to two flanges 54, which extend radially outwardly from the radially outer end of the spindle 50, by a hinge pin 56. The operating lever 28 may pivot about the hinge pin 56 in a radial direction to allow transverse movement of the control ring, as shown by arrows D in FIG. 10. The requirement for a fixed axial position of the control ring or a fixed axial distance X between the control ring and the spindles 50 of the stator vanes 26 requires that the operating levers 28 are able to vary their length when the control ring is displaced transversely. The operating lever 28 has a first portion 120 which is secured to the flanges 54 by the pin 56, and a second portion 124 which is secured to the control ring. The first portion 120 has a cylindrical bore 122, and the second portion 124 which is partially cylindrical and of corresponding diameter to that of the bore 122, fits in the bore 122. The second portion 124 is free to move by sliding axially in the bore 122 to vary the effective length of the operating lever 128. The second portion may be slidably mounted on the first portion by other equally suitable arrangements.

The direction of the transverse movement of the control ring is chosen to suit the particular distortions the compressor of the engine is going to experience in operation.

The invention may be applied to more than one stage of variable stator vanes and may be applied to the inlet guide vanes of the compressor.

I claim:

1. A variable stator vane arrangement for an axial flow compressor comprising a plurality of circumferentially arranged radially extending stator vanes mounted for rotation about their longitudinal axes in a stator structure, a control ring surrounding the stator structure, a plurality of circumferentially arranged operating levers, each operating lever extending from the control ring to a respective stator vane, the control ring being movable between a first position in which the control ring is coaxial with the compressor and a second position in which the axis of the control ring is displaced transversely with respect to the axis of the compressor, the control ring being movable from the first position to the second position such that the stator vanes in a first circumferentially extending zone of the compressor are rotated in a first direction whereby the first zone operates at a relatively higher pressure ratio and the stator vanes in a second diametrically opposite circumferentially extending zone of the compressor are rotated in the opposite direction whereby the second zone operates at a relatively lower pressure ratio; each operating lever comprising two parts, one part being slidably mounted in the outer to allow for variation in effective length of each operating lever.

2. A variable stator vane arrangement as claimed in claim 1 in which each operating lever is secured to the radially outer end of a respective stator vane by hinge means so that each operating lever pivots in a radical direction to allow transverse movement of the control ring.

3. A variable stator vane arrangement as claimed in claim 1 in which each operating lever has a spherical portion which engages a correspondingly shaped aperture in the control ring.

4. A variable stator vane arrangement as claimed in claim 1 in which the control ring is rotatably mounted coaxially in a second control ring, the second control ring is movable between the first position in which the control ring is coaxial with the compressor and the second position in which the axis of the control ring is displaced transversely with respect to the axis of the compressor.

5. A variable stator vane arrangement as claimed in claim 4 in which the control ring is rotatably mounted in the second control ring by bearing means.

6. A variable stator vane arrangement as claimed in claim 5 in which the bearing means comprises a roller bearing, a ball bearing or a sliding bearing.

7. A variable stator vane arrangement as claimed in claim 4 in which the second control ring has first transversely extending track means, and the stator structure has second transversely extending track means, the first and second transversely extending track means being arranged parallel to allow and to guide the relative movement between the second control ring and the stator structure.

8. A variable stator vane arrangement as claimed in claim 7 in which bearing means allows relative movement between the second control ring and the stator structure.

9. A variable stator vane arrangement as claimed in claim 8 in which the bearing means comprises a roller bearing, a ball bearing or a sliding bearing.

10. A variable stator vane arrangement as claimed in claim 4 in which the second control ring is connected to the stator structure by two parallel links, the two parallel links being pivotally connected to the second control ring and the stator structure.

11. A variable stator vane arrangement as claimed in claim 10 in which the parallel links are of equal length.

12. A variable stator vane arrangement as claimed in claim 10 in which the parallel links are arranged substantially perpendicular to the required direction of transverse movement to allow transverse movement.

13. A variable stator vane arrangement as claimed in claim 4 in which an actuating ram is interconnected to the stator casing and second control ring to move the second control ring transversely.

14. A variable stator vane arrangement as claimed in claim 4 in which the control ring is rotated about the axis of the second control ring whereby the stator vanes rotate in the same direction.

15. A variable stator vane arrangement as claimed in claim 1 in which the control ring is rotatably mounted on the stator structure about the axis of the compressor, the control ring being rotated whereby the stator vanes rotate in the same direction.

16. A variable stator vane arrangement as claimed in claim 1 in which the axial flow compressor is the compressor of a gas turbine engine.

* * * * *